US006434797B1

(12) United States Patent
Sagman

(10) Patent No.: US 6,434,797 B1
(45) Date of Patent: Aug. 20, 2002

(54) PACIFIER CORD RETRACTING DEVICE

(76) Inventor: Susan Sagman, 9007 D Boca Gardens Cir. S., Boca Raton, FL (US) 33496

( * ) Notice: Subject to any disclaimer, the term of this patent is extended or adjusted under 35 U.S.C. 154(b) by 0 days.

(21) Appl. No.: 09/650,365

(22) Filed: Aug. 29, 2000

Related U.S. Application Data

(60) Provisional application No. 60/154,479, filed on Sep. 17, 1999.

(51) Int. Cl.[7] ..... A61J 17/00

(52) U.S. Cl. ..... 24/3.13; 24/3.1; 242/381.3

(58) Field of Search ..... 24/3.1, 3.11, 3.12, 24/3.13; 242/285.4, 365.3, 422.5, 381.6, 396.3, 396.5, 396.7, 396.8, 381, 381.1, 381.3, 385.4

(56) References Cited

U.S. PATENT DOCUMENTS

| | | | | | |
|---|---|---|---|---|---|
| 1,831,666 | A | * | 11/1931 | Jacobia | 242/385.4 |
| 2,248,338 | A | * | 7/1941 | Castleman | 24/3.13 X |
| 3,042,338 | A | * | 7/1962 | Ljungberg | 242/381.3 X |
| 3,435,529 | A | * | 4/1969 | Quenot | 242/381.3 X |
| D225,039 | S | * | 10/1972 | Sauritis | D24/195 |
| 4,405,472 | A | * | 9/1983 | Burtscher | 242/381.3 X |
| 4,449,302 | A | * | 5/1984 | Drechsler et al. | 242/381.3 X |
| 4,527,334 | A | * | 7/1985 | Jones et al. | 242/381.3 X |
| 4,927,092 | A | * | 5/1990 | Ingram, II et al. | 242/381.3 X |
| 4,998,356 | A | * | 3/1991 | Chaping | 242/381.3 X |
| 5,026,274 | A | * | 6/1991 | Jacob | 24/3.11 X |
| 5,150,504 | A | * | 9/1992 | Cohen | 24/3.13 X |
| 5,794,357 | A | * | 8/1998 | Gilliam et al. | 33/767 |
| 5,806,202 | A | * | 9/1998 | Blackman et al. | 242/381.3 X |
| 5,957,399 | A | * | 9/1999 | Siana, Jr. | 242/381.3 X |
| 6,026,585 | A | * | 2/2000 | Li | 242/381.3 X |
| 6,053,447 | A | * | 4/2000 | Omri | 242/381.3 X |
| 6,241,750 | B1 | * | 6/2001 | Moultrie | 606/234 |

* cited by examiner

*Primary Examiner*—J. J. Swann
*Assistant Examiner*—Ruth C. Rodriguez
(74) *Attorney, Agent, or Firm*—Robert M. Downey, P.A.

(57) ABSTRACT

The device includes a housing having a rear face with a clip thereon for releasably securing the housing to a child's clothing or other article which is convenient to the user. An elongate cord includes a proximal end secured to a spring biased roller within the housing. The cord extends through a channel in the housing and out through an opening in the side of the housing to a free distal en d portion which includes a fastener for securing the distal end portion to a pacifier. In a relaxed state, the spring biased roller maintains the cord wound thereabout so that the distal end portion of the cord and attached pacifier are adjacent the housing. Upon pulling the distal end portion and pacifier away from the housing, to thereby unwind the cord from the roller, a recoil tension is placed on the roller, urging the roller in the opposite rotational direction thereby retracting the cord into the housing so that the distal end portion and pacifier are brought back to the housing once the pacifier is removed from the child's mouth.

3 Claims, 2 Drawing Sheets

PACIFIER CORD RETRACTING DEVICE

This application claims benefit of provisional application Ser. No. 60/154,479, filed Sep. 17, 1999.

BACKGROUND OF THE INVENTION

1. Field of the Invention

The present invention relates to a device for securing a pacifier to a child and, more specifically, to a device attachable to a child's clothing and including means for retracting an elongate cord attached to a pacifier.

2. Description of the Related Art

Pacifiers of various design are well known and have been in use for many years. For infants and toddlers, the pacifier is often the only means of comfort, especially to relieve the pain and irritability experienced from incoming teeth. It is, therefore, not surprising that most parents eventually become somewhat dependent on the use of a pacifier to calm their young children, especially when they are away from home.

One common problem, in particular, which is encountered by virtually every parent is the need to constantly retrieve the pacifier and replace it in the mouth of their child each time the child drops it or spits it out. And, because this happens quite frequently, the problem can become quite annoying for both the parent and child. Inevitably, the pacifier finds it way to a dirty floor or other unclean surface, rendering the pacifier contaminated and unfit for use until it can be cleaned and sterilized with soap and hot water. Unfortunately, the ability to clean and sterilize a pacifier is not always available and, if a spare pacifier is not readily handy, a parent or babysitter may find themselves in a desperate situation.

In an effort to solve the above problem, various devices have been developed which serve the purpose of securing the pacifier to the child. Typically, these devices include an elongate cord, strap, leash, etc. of approximately 18–24 inches in length with means at one end for securing the device to the pacifier and clip means on the other end to attach the strap to the child's clothing. However, these devices do not fully solve the problem, as the strap is usually of a length which still permits the pacifier to fall to an unclean surface. For instance, when a child is in a stroller, the pacifier may be thrown to the side, out of the stroller, and may reach the ground. Otherwise, the pacifier and strap may become entangled in the wheels of the stroller. In other instances, the pacifier is dropped between the child's body and the child's seat, makings it difficult for the parent to locate and retrieve the pacifier, especially while driving.

Accordingly, there is a need for a device which secures a pacifier to a strap, cord, etc. and which is further adapted to retract the cord and pacifier so that the pacifier is readily accessible in close proximity to the child's mouth, when needed.

OBJECTS AND ADVANTAGES OF THE INVENTION

With the foregoing in mind, it is a primary object of the present invention to provide a device which is particularly suited for securing a pacifier to a child's clothing so that the pacifier cannot be dropped on the floor or lost and, further wherein the pacifier is readily accessible in close proximity to the child's mouth, when needed.

It is still a further object of the present invention to provide a device which is adapted for attachment to a child's clothing, and wherein the device includes a retractable strap having a means on a distal end for securing the strap to a pacifier.

It is yet a further object of the present invention to provide a device which is adapted for releasable attachment to clothing, and wherein the device includes a retractable strap having attachment means for securing an article to the strap.

It is yet a further object of the present invention to provide a device which is adapted for removable attachment to clothing, and wherein the device includes a retractable strap having means for fastening various articles to the strap including, but not limited to, pens, identification cards, photos, whistles and other like articles.

It is still a further object of the present invention to provide a device with a retractable strap, as set forth above, for securing various articles to a person's clothing, and wherein the device is relatively inexpensive to manufacture and adapted for mass market distribution.

It is yet a further object of the present invention to provide a device with a retractable strap for securing various articles to a person's clothing, and wherein the device is readily adapted for displaying advertisements, trademarks, logos, messages, slogans, animated characters, photos and other graphics and designs.

SUMMARY OF THE INVENTION

The present invention is directed to a device which includes a housing having a rear face with a clip thereon for releasably securing the housing to a person's clothing or other article which is convenient to the user. An elongate cord includes a proximal end secured to a spring-biased roller within the housing. The cord extends through a channel in the housing and out through an opening in the side of the housing to a free distal end portion which includes a fastener for securing the distal end portion to an article being carried by the user. In a preferred embodiment, the distal end portion is adapted to be fastened to a pacifier and the housing clips to a child's clothing, thereby allowing the child to drop the pacifier from his/her mouth without losing or contaminating the pacifier. It is noted, however, that other articles are contemplated for fastening to the cord, such as pens, ID cards, photos, whistles, to name a few, and, accordingly, the present invention is not intended to be limited for use to secure a pacifier to a child.

In a relaxed state, the spring biased roller maintains the cord wound thereabout so that the distal end portion of the cord and the attached pacifier are adjacent the housing. Upon pulling the distal end portion and pacifier away from the housing, to thereby unwind the cord from the roller, a recoil tension, is placed on the roller, urging the roller in the opposite rotation direction. In one embodiment, a brake is pressed against the cord, within the channel, to hold the cord at the selected, extended position, and to prevent the roller from recoiling and winding the cord back into the housing. A button on the exterior of the housing releases the brake from the cord to permit recoiling of the roller, thereby retracting the cord into the housing so that the distal end portion and pacifier are brought back to the housing.

BRIEF DESCRIPTION OF THE DRAWINGS

For a fuller understanding of the nature of the present invention, reference should be made to the following detailed description taken in conjunction with the accompanying drawings in which.

DETAILED DESCRIPTION OF THE PREFERRED EMBODIMENT

Figure 1:
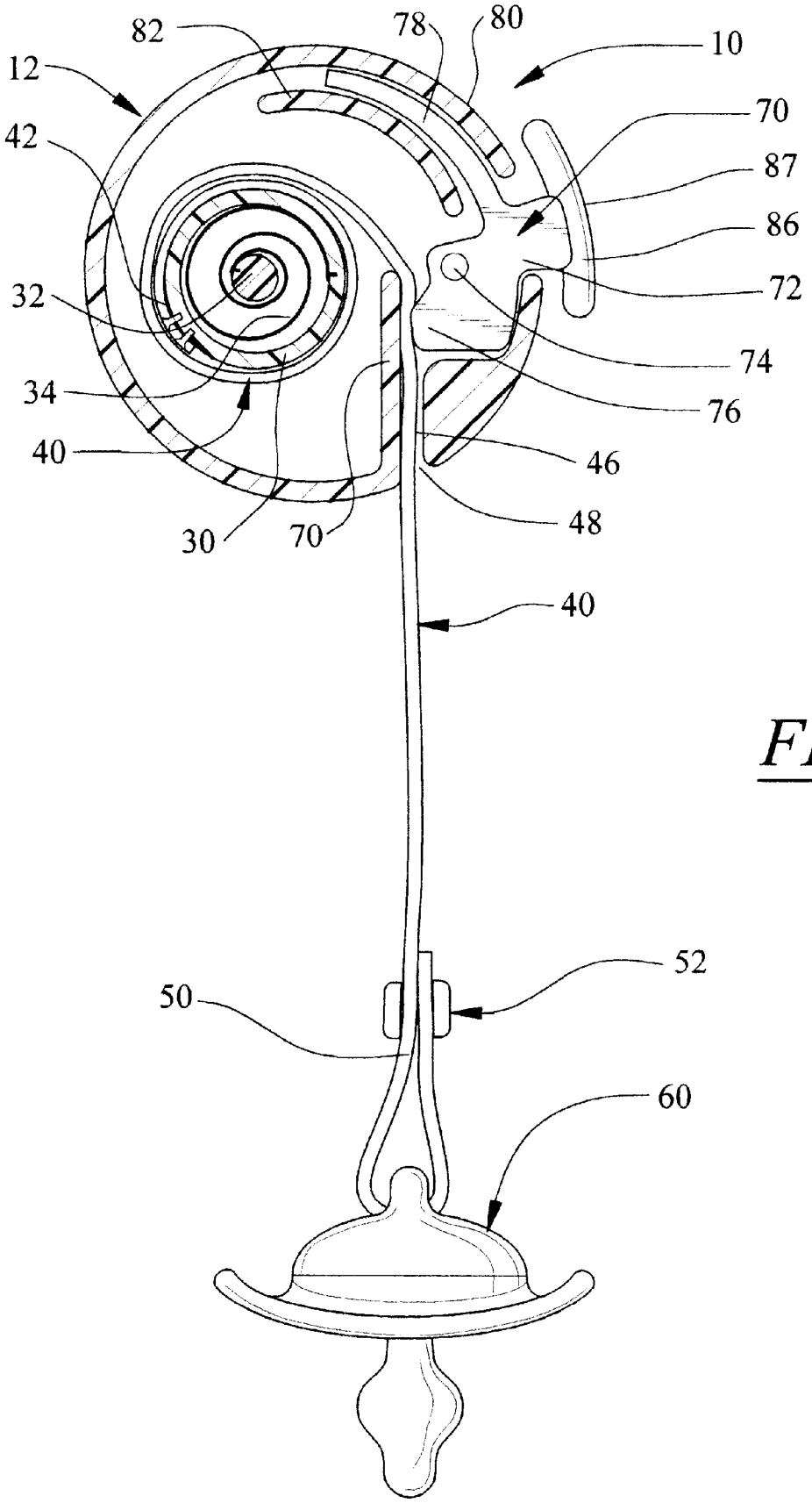
FIG. 1 is a front elevation, in partial cross-section, showing the device of the present invention secured to a pacifier.
Figure 2:
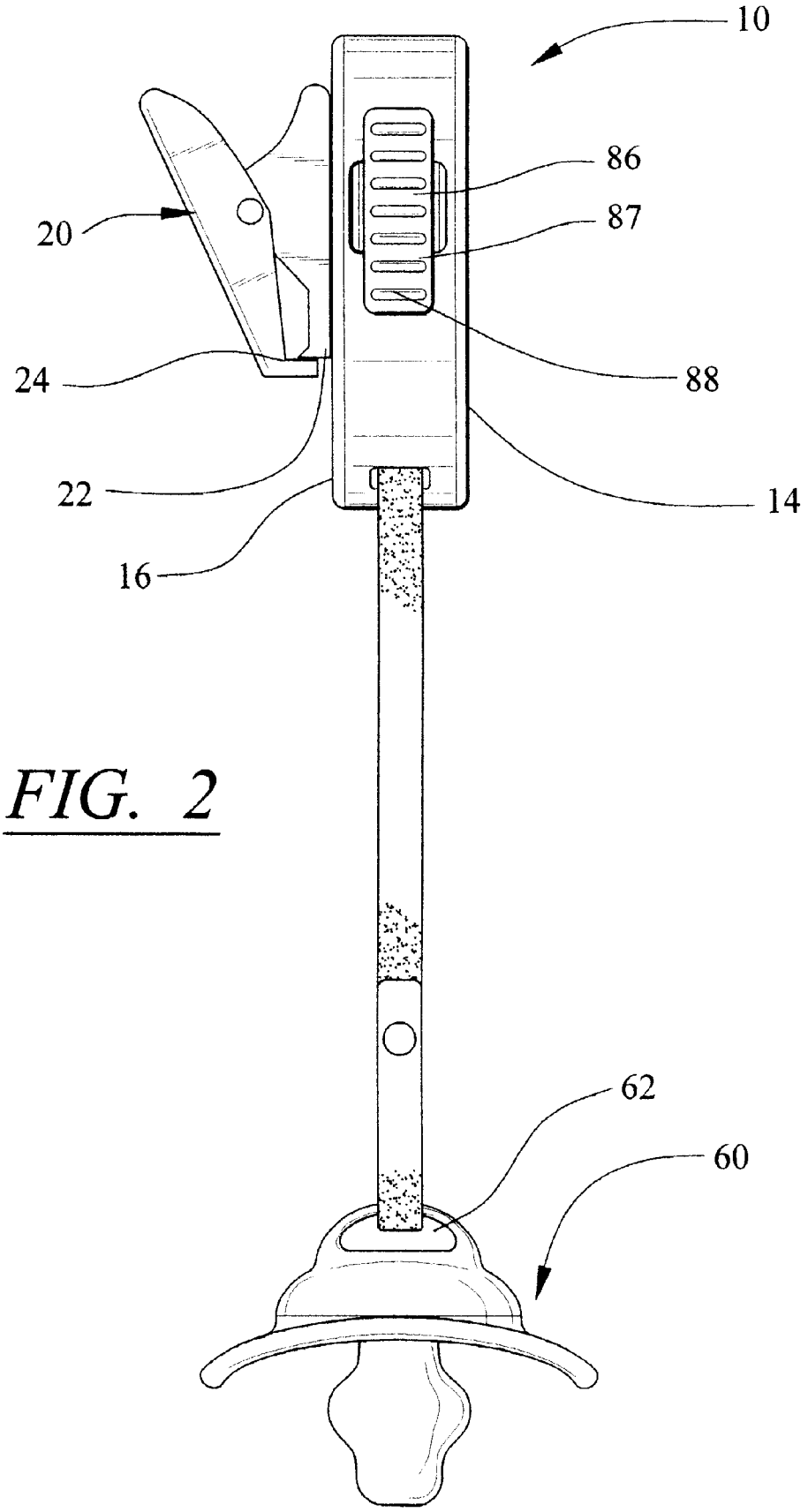
FIG. 2 is a side elevational view of the device, shown attached to a pacifier Like reference numerals refer to like parts throughout the several views of the drawings.

Referring to FIGS. 1 and 2, the device of the present invention is shown and generally indicated as 10. The device 10 includes a housing 12 which, in a preferred embodiment, is generally circular in shape and includes a front face 14 and a rear face 16. Clip means 20 are provided on the rear face to releasably attach the housing to a child's clothing, such as a pocket on a shirt. The clip means may further be used to attach the device to another convenient article, such as a stroller, toy, or carry bag. In a preferred embodiment, the clip means includes an alligator-type clip with opposing jaws 22, 24 which are urged together, by a spring element, to maintain the jaws closed.

A roller 30 within the housing is secured to a central axis 32 by a coiled biasing element 34. Viewing FIG. 1, upon clockwise rotation of the roller 30, the biasing element 34 is compressed to generate a recoiling force which is exerted on the roller, urging the roller in the clockwise rotational direction. An elongate strap, cord, leash or the like 40 is secured at a proximal end 42 to the roller using screws, glue or other suitable means and is wound about the roller. The cord 40 extends through a channel 46 and outwardly from an exit opening 48 of the housing to a free distal end portion 50 positioned exteriorly of the housing. The distal end portion of the cord includes fastening means for securing the distal end portion in a loop, as seen in FIG. 1. The fastening means 52 may include a snap fastener, a hook and loop fastener, or other releasable fastening means. The cord 40 is secured to a pacifier 60 by passing the distal end portion 50 through an opening 62 on the pacifier 60, as seen in FIG. 2, and securing the distal end portion 50 to itself, forming a loop, using the fastening means 52. In a relaxed state, the roller 30 maintains the distal end portion 50 and pacifier 60 in close, adjacent position to the exit opening 48, so that the pacifier 60 is maintained close to the housing 12. To extend the cord 40 and move the pacifier 60 away from the housing 12, the cord 40 and/or pacifier 60 are pulled so that the cord travels outwardly through the channel 46 and out the exit opening 48 as the roller 30 rotates in the clockwise direction (when viewed as in FIG. 1), causing the spring element 34 to compress. In one embodiment, a brake means 70 is used to engage the cord 40 within the channel 46, holding the cord so that it is not rewound onto the roller 30 in response to the recoiling force of the spring element 34. The brake means 70 is specifically structured to permit the cord to be pulled through the channel and out from the exit opening and provides sufficient friction against the cord to hold it in the selected, extended position. It is noted that the device can be manufactured without the brake means, whereby the cord and attached pacifier retract immediately upon the removal of the pacifier from the child's mouth.

In a preferred embodiment, the brake means 70 includes a brake member 72 which is pivotally fitted to the housing on axis 74. A head portion 76 of the brake means 70 engages the cord 40 and pinches the cord against a wall 77 of the channel. An opposite arm portion 78 extends upwardly between an outer wall 80 of the housing 12 and an inner wall portion 82. The arm portion 78 is provided with a flexible memory which urges the brake member 72 about the pivot axis 74 so that the head portion 76 moves towards the wall 77 of the channel 46 and against the cord 40. A depressible button 86 fitted to the brake member 72 is accessible from an exterior of the housing and includes a generally arcuate outer surface 87 with grip means 88 thereon to facilitate depressing with a finger, such as the thumb, thereby urging the brake member 72 in the opposite direction about the pivot axis 74 so that the head portion 76 is released from the strap 40, thereby permitting the roller 30 to recoil and retract the cord 40 so that the cord becomes wound about the roller. Thus, when the cord 40 is extended and it is desired to retract the cord and move the pacifier 60 back into close proximity to the housing 12, the button 86 is depressed, releasing the brake member 72 from the cord 40 and thereby permitting the spring element 34 to recoil the roller 30 in a counter-clockwise direction so that the cord 40 is pulled back into the housing and wound on the roller until the spring element reaches the relaxed state, at which point the roller is stopped with the end portion 50 of the cord and the pacifier 60 positioned closely adjacent the housing.

While the instant invention has been shown and described in what is considered to be a preferred and practical embodiment thereof, it is recognized that departures from the instant disclosure are contemplated within the spirit and scope of the invention as defined in the following claims.

What is claimed is:

1. A device for securing a pacifier to a child's clothing comprising:

a housing having a rear face and an opening communicating with an interior of said housing;

a cord including a distal end zone maintained exteriorly of said housing and an opposite proximal end zone anchored within said housing, said cord extending through said opening of said housing;

fastening means on said distal end zone of said cord for releasably securing said cord to the pacifier;

means for extending and retracting said cord relative to said housing, said extending and retracting means comprising:

roll means for winding and unwinding said cord within said interior of said housing, and said proximal end zone of said cord being anchored to said roll means;

spring biased recoil means for rotating said roll means to wind said cord thereabout and retract said cord so that said distal end zone moves towards said opening of said housing; and brake means for normally holding said cord in a fixed position relative to said housing and resisting winding and retracting of said cord into said housing, said brake means being operable to selectively release said cord in order to permit winding and retracting into said housing so that said distal end zone moves towards said opening.

2. A device for securing an article to a person's clothing comprising:

a housing having a rear face, an interior chamber, an opening communicating with said interior chamber, and a channel extending between said opening and said interior chamber, and said channel including a channel wall surface;

a post extending through said interior chamber and defining a central axis, and said post having an outer diameter;

a rigid ring-shaped roller having an inner circumferential surface, an outer circumferential surface, and an inner diameter measured between said inner circumferential surface, and said inner diameter of said roller being greater than said outer diameter of said post;

a cord including a distal end zone maintained exteriorly of said housing and an opposite proximal end zone anchored to said outer circumferential surface of said roller, and said cord extending through said channel and said opening of said housing;

fastening means on said distal end zone of said cord for releasably securing said cord to the article;

means for extending and retracting said cord relative to said housing between a fully extended position, defined by a maximum distance at which said distal end zone can be spaced from said housing, and a fully retracted position defined by said distal end zone positioned adjacent to said opening of said housing with a minimum length of said cord extending out from said opening, said extending and retracting means comprising:

a spring-biased coil between said post and said roller and including a first end secured to said post and a second end secured to said inner circumferential surface of said roller; and said spring-biased coil being structured and disposed to permit rotation of said roller relative to said post between a normally relaxed position and a loaded position, and said spring-biased coil being further structured to urge rotation of said roller to said normally relaxed position;

brake means for holding said cord at a select extended position in order to prevent retracting and winding of said cord about said roller, said brake means being normally disposed in holding engagement with said cord to resist retracting and winding of said cord about said roller, and said brake means being operable from said normally holding engagement with said cord to a released position in order to permit retracting and winding of said cord about said roller;

said brake means comprising a brake member pivotally fitted to said housing on a pivotal axis and including a head portion structured and disposed to engage said cord and pinch said cord against said channel wall surface when said brake means is in said normally holding engagement with said cord, and said brake member further comprising an arm portion having a flexible memory for urging said brake member about said pivotal axis so that said head portion is moved in pinching engagement with said cord against said channel wall surface, and said brake member further comprising a depressible button on an exterior of said housing for urging the brake member about said pivotal axis in order to release said head portion from pinching engagement with said cord; and attachment means for removably attaching said housing to the person's clothing.

3. The device as recited in claim 2 wherein said fastening means is structured and disposed for releasably securing said distal end zone of said cord to a pacifier.

* * * * *